United States Patent [19]

Antoine et al.

[11] 4,124,200

[45] Nov. 7, 1978

[54] CONVERTER FOR REFINING LIQUID METALS, WITH HEATING AND BLOWING IN MEANS

[75] Inventors: Lucien Antoine, Fraisses; André Maubon, Saint-Etienne; Gérard Largeron, Saint-Germain-le-Puy, all of France

[73] Assignees: Creusot-Loire Enterprises, Courbevoie-La-Defense; Clesid S.A., Saint Chamond, both of France

[21] Appl. No.: 811,675

[22] Filed: Jun. 29, 1977

[30] Foreign Application Priority Data

Jul. 9, 1976 [FR] France ..... 76 21111

[51] Int. Cl.[2] ..... C21C 5/40

[52] U.S. Cl. ..... 266/158; 266/245

[58] Field of Search ..... 75/60; 266/142, 143, 266/158, 218, 220–226, 243–248

[56] References Cited

U.S. PATENT DOCUMENTS

| | | | |
|---|---|---|---|
| 784,956 | 3/1905 | Morat | 266/218 |
| 3,138,648 | 6/1964 | McFeaters | 266/158 |
| 3,219,322 | 11/1965 | Murer | 266/158 |
| 3,235,242 | 2/1966 | Fukuda | 266/225 |
| 3,796,421 | 3/1974 | Knuppel et al. | 266/158 |
| 3,844,769 | 10/1974 | Calderon | 266/158 |
| 3,912,243 | 10/1975 | Chang | 266/226 |

*Primary Examiner*—Gerald A. Dost

*Attorney, Agent, or Firm*—Haseltine, Lake & Waters

[57] ABSTRACT

A converter for refining a liquid metal bath using simultaneous heating and blowing in comprises a metal vessel internally lined with refractory material, having an upwardly open mouth and having a generally cylindro-frustoconical shape which is a body of revolution about an axis, the vessel being mounted on, and rotatable about, its axis of revolution relative to a pivotable cradle, the vessel having a pouring spout and a set of tuyeres extending through a wall thereof, and a separate frustoconical cap connected to a gas collection hood for surmounting the vessel and provided with an opening through which a heating device can extend into the vessel, the arrangement being such that in the 'normal' position of the vessel, for simultaneous blowing in and heating, the axis of revolution of the vessel is at an angle between 35° and 55° to the vertical, the pouring spout is upwardly directed, the tuyeres extend upwardly from the bottom of the vessel and the vessel is surmounted by the cap.

8 Claims, 5 Drawing Figures

CONVERTER FOR REFINING LIQUID METALS, WITH HEATING AND BLOWING IN MEANS

FIELD OF THE INVENTION

The present invention relates to a converter for refining metals in the liquid state, which converter includes both means for heating and a set of tuyeres.

PRIOR ART

Hitherto converters for refining metals in the liquid state as used industrially were deprived of means for heating the metals during the course of refining. Designs of tilting converters equipped with electrodes as described in certain old patents have never been developed industrially.

On the other hand furnaces for melting and refining such as, for example, Martin furnaces and electric arc furnaces, in the case of appliances working up steel, have sometimes attempted to add refining means, such as lances or tuyeres, to their heating means. But in doing this, the melting-and-refining furnaces have preserved all their original structural characteristics. Hence, considerable difficulties have been encountered in the adoption of powerful blast means enabling blast periods to be achieved which are as short as those of converters.

SUMMARY OF THE INVENTION

According to the present invention there is provided a converter for refining a liquid metal using simultaneous blowing in and heating, the converter comprising:

a metal vessel for receiving a liquid metal bath, internally lined with refractory material and having an upwardly open mouth, said vessel having a generally cylindro-frustoconical shape and being a body of revolution about an axis;

a cradle;

means mounting said vessel in said cradle for rotation relative thereto about said axis of revolution;

means mounting said cradle for tilting movement;

a pouring spout on said vessel;

a set of tuyeres extending through a wall of said vessel into the interior thereof;

a frustoconical cap secured to said cradle and lined with refractory material for surmounting said open mouth of said vessel, said cap being separate from said vessel, and defining an opening for receiving heating means; and a hood for collection of gases and communicating with said cap;

the arrangement being such that, in the 'normal' operative position of said converter for simultaneous blowing in and heating, said axis of revolution of said vessel is at an angle of between 35° and 55° to the vertical, said pouring spout is directed upwardly, said tuyeres are arranged to be submerged in a metal bath and to blow in from the bottom of said vessel upwardly, and said vessel is surmounted by said cap.

Preferably heating means are provided selected from the group formed by: three threephase electrodes; a fuel-oil burner; a plasma torch; two single phase electrodes.

Said heating means are advantageously movable vertically and are introduced into said converter vessel from the top downwards through said cap.

Said vessel of said converter may be rotated about said axis of revolution through a certain angle during simultaneous heating and blowing in, that is to say, in said 'normal' position of said vessel.

Said vessel advantageously includes means through which raking off of slag may be effected, said vessel rotating about its axis of revolution to reach a position for raking off the slag. For pouring the metal into a ladle said vessel is also rotated about its axis of revolution and in this case the rotation is through 180° from the 'normal' position to place the pouring spout in a lower position.

Said cap may include an opening above which is located means of known type for charging with solid matter, for introducing solid matter into the converter vessel either discontinuously or continuously during simultaneous heating and blowing in.

Said cap and hood for collection of gases is advantageously secured to said cradle. Means for supporting said heating means may also be secured to said cradle.

Alternatively, said cap, said hood and said support for said heating means are mounted on a carriage, a false cap for said vessel is also mounted on said carriage such that in said 'normal' position of said vessel, said cap surmounts said vessel and after tilting of said cradle for pouring, said false cap surmounts said vessel, which has the effect of reducing the weight of the unit to be tilted.

In a modification said carriage is replaced by two distinct carriages fulfilling the same purpose but less bulky, the first of said carriages supporting said cap, said hood and said heating means support, and the second of said carriages supporting said false cap which comes into place on the vessel at the time of pouring into a ladle.

In a further embodiment, the support for the heating means is fixed and the heating means is moved out of the cap when not in use, a false cover being brought into a position blocking the apertures in the cap thus left free.

Raking off may be effected through an opening arranged in the wall of said vessel, said opening being located so that it provides for raking off in the 'normal' position of said vessel and in the position of said vessel for starting pouring into a ladle.

The tuyeres may be provided with an inlet for a peripheral agent for protection of the blastpipes against wear during the course of blowing in.

One or more rotating joints may be located under said vessel and on its axis of revolution, said joints, being connected as required to flexible pipes, enable feeding of said tuyeres with various fluids and permit rotation of said vessel about its axis and also tilting of said cradle.

Said vessel may, in operation, be placed under reduced pressure or under vacuum by means of suction applied through said cap and said hood, said cap then coming into contact with said vessel.

As will be understood, one of the main advantages of a rotary converter as described above is that of providing the user with great flexibility of operation.

That is:

(a) There is available both a means of heating; electrodes, or burner, or plasma torch, and a means of refining the tuyeres.

(b) These means may be employed conjointly or separately: conjointly when the converter is in the 'normal' position; separately, in the following two cases:

1. The converter is still in the 'normal' position, the tuyeres are submerged during the course of blowing in, the heating means being withdrawn and the apertures for introduction of the means of heating into the cap being blocked by any suitable means, for example, by a false cover lined with refractory material. This is blowing in without heating.

2. The converter vessel has been rotated about its axis by 180°, the tuyeres having thereby emerged above the level of the bath, the heating means are in place and in operation. This is heating without blowing in, for example, in order to achieve under satisfactory conditions, the putting of final finishing touches to the steel being worked up.

(c) The combination of rotation of the vessel about its axis of revolution and of tilting of the vessel and cradle enables it to take up a very great number of positions.

(d) By its shape and by its collection of the gases the converter enables blast powers to be achieved which are close to those of traditional converters and hence greater than those of the lances and the tuyeres employable in traditional Martin furnaces and electric arc furnaces.

(e) The conjoint use of heating means, means of blowing in and charging with solid matter, associated with the two operative positions: tuyeres submerged and tuyeres exposed, affords the converter a flexibility of operation and an ability to adapt to every metallurgical operation, which are absolutely astonishing.

BRIEF DESCRIPTION OF THE DRAWINGS

The invention will be more fully understood from the following description of an embodiment thereof, given by way of example only, with reference to the accompanying drawings.

In the drawings:

FIG. 1 is a vertical section through an embodiment of a rotary converter in accordance with the present invention, taken along the vertical plane passing through the inclined axis of revolution of the vessel and the cap, and when the converter is in the operative 'normal' position for simultaneous heating, melting and blowing in;

DETAILED DESCRIPTION

Figure 1:
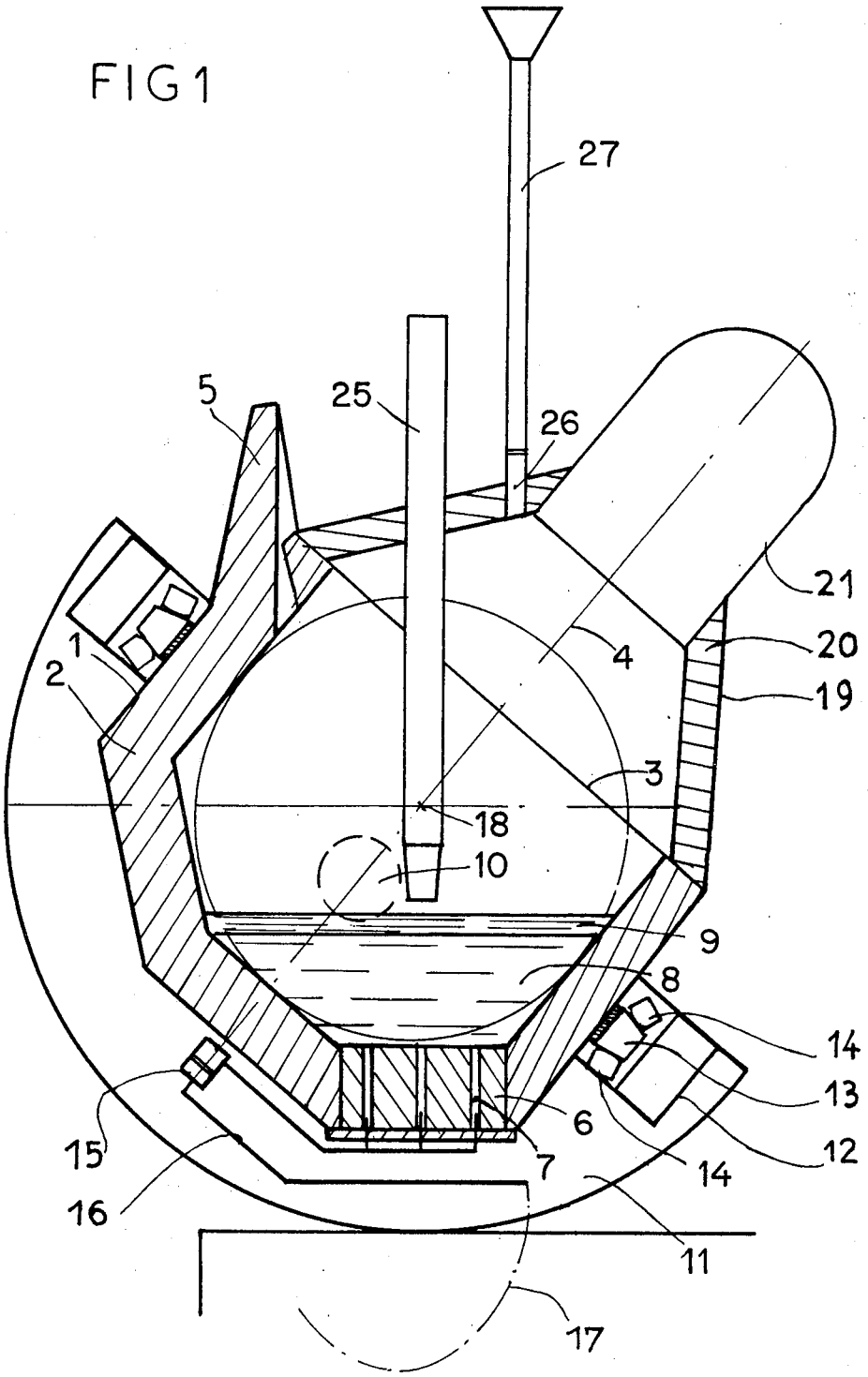

The rotary converter shown in the drawings has heating means comprising three threephase electrodes, has a capacity of 140 tons of liquid steel, and is equipped with ten tuyeres. The converter comprises, as may be seen in FIG. 1, a metal vessel 1, lined internally with refractory material 2, having an upwardly open mouth in the plane 3, and having a cylindro-frustoconical shape which is a body of revolution about the axis 4.

In the operative 'normal' position, for simultaneous heating and blowing in the axis of revolution 4 is inclined at between 35° and 55° to the vertical and preferably, as shown in FIG. 1, at 45° to the vertical.

The vessel 1 includes three parts which are not those of revolution about the axis 4:

the pouring spout 5 lined with refractory material and directed upwardly in FIG. 1;

the block 6 of tuyeres 7, which block is arranged in such a way that in the 'normal' position the tuyeres are submerged in the metal bath 8, surmounted by slag 9, and the tuyeres can thus blow in from the bottom upwards; and the aperture 10 for raking off, which is not located in the plane of FIG. 1 and which is represented in FIG. 1 by its projection into the plane of the Figure, in broken lines. This aperture 10 is located in a position such that the slag can be raked off at the end of a metallurgical operation, at the maximum level of the bath and of the slag, the vessel being in the 'normal' position, as in FIG. 1. This aperture 10 may however also be used for raking off the slag during the course of a metallurgical operation even at a time when the level of the bath and that of the slag are lower than their maximum level simply by rotating the vessel 1 about its axis of revolution 4 in the appropriate direction, the tuyeres then blowing in in a sloping position.

The converter also includes a tilting cradle 11 which is rotatable about axis 18 and includes a metal cage 12 inside which are pairs of rollers 14 mounted on spindles. Each of these pairs of rollers enclose between them a crown 13 integral or fast with the vessel of the converter. The vessel is rotated about the axis 4 while resting on the rollers 14 by means of a mechanism of known tupe not shown in the Figures, for example, similar to that of a Kaldo furnace.

In the present embodiment the tuyeres 7 are double tuyeres blowing in oxygen in the center and protected against wear by a flow of fuel-oil between the two tubes of each tuyere. They are fed with oxygen by a circuit of known type. A particular feature of this circuit is that it includes a rotating joint 15 which is arranged under the vessel, along the axis of revolution 4, and that its fixed portion is integral with or fixed to the tilting cradle 11. Thus, when the vessel 1 turns about its axis 4 (chaning from FIG. 1 to FIG. 3), the rotating joint 15 does not change position, its fixed portion does not move and its movable portion turns with the vessel, while, when the whole of the converter tilts without the vessel turning (changing from FIG. 3 to FIG. 4), the rotating joint 15 tilts with the cradle 11. The fixed portion of this rotating joint 15 is fed by a pipe 16 integral with the cradle 11. The pipe 16 is fed, taking into account the rotation of the cradle 11 and of the whole of the system, either by a flexible pipe 17 or by another rotating joint, not shown in the Figures, arranged on the axis 18 of rotation of the cradle 11.

Figure 5:
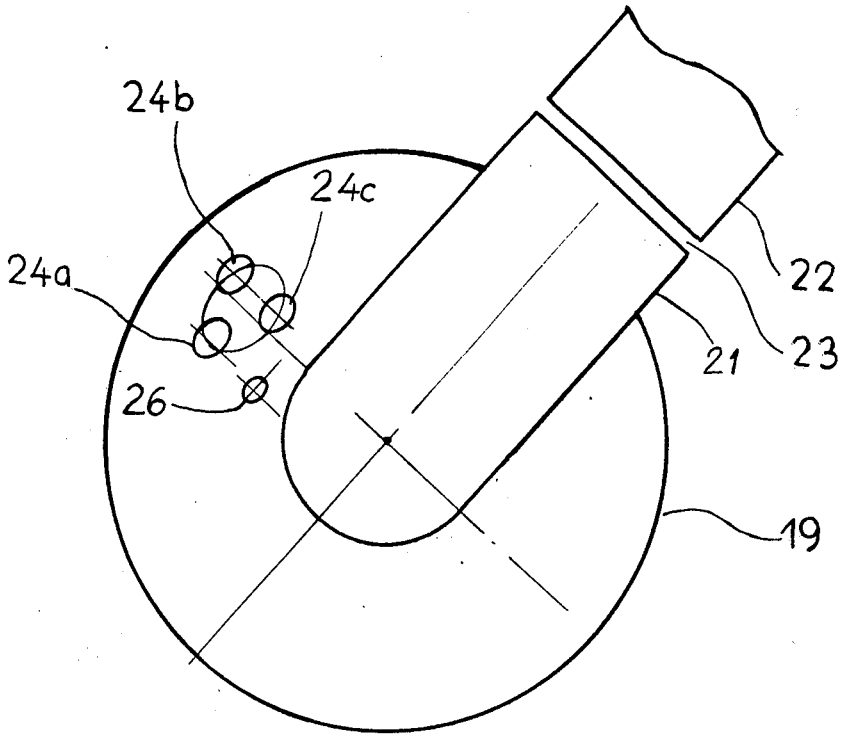
FIG. 5 is a plan view of the cap and of the collector hood along the axis of symmetry.

Above the vessel 1 is arranged a cap 19 lined inside with refractory material 20, having the same axis as the axis 4 of the vessel 1. This cap 19 has the shape of a truncated cone and is in turn surmounted by a hood 21 for collection of gases and connected to a duct 22 (FIG. 5) which is connected to a system, not shown in the Figures, for cooling and extracting dust from the gases.

The unit formed by the cap 19 and the hood 21 is independent of the vessel 1 and hence does not rotate with it. In the present embodiment this unit is secured to the tilting cradle 11, with the result that it continues to cap the vessel during pouring of the metal into a ladle, in the position shown in FIG. 4. A seal 23, which may be seen in FIG. 5, exists between the hood 21 which moves with the cradle 11, and the duct 22 for suction of the gases which is fixed.

Figure 3:
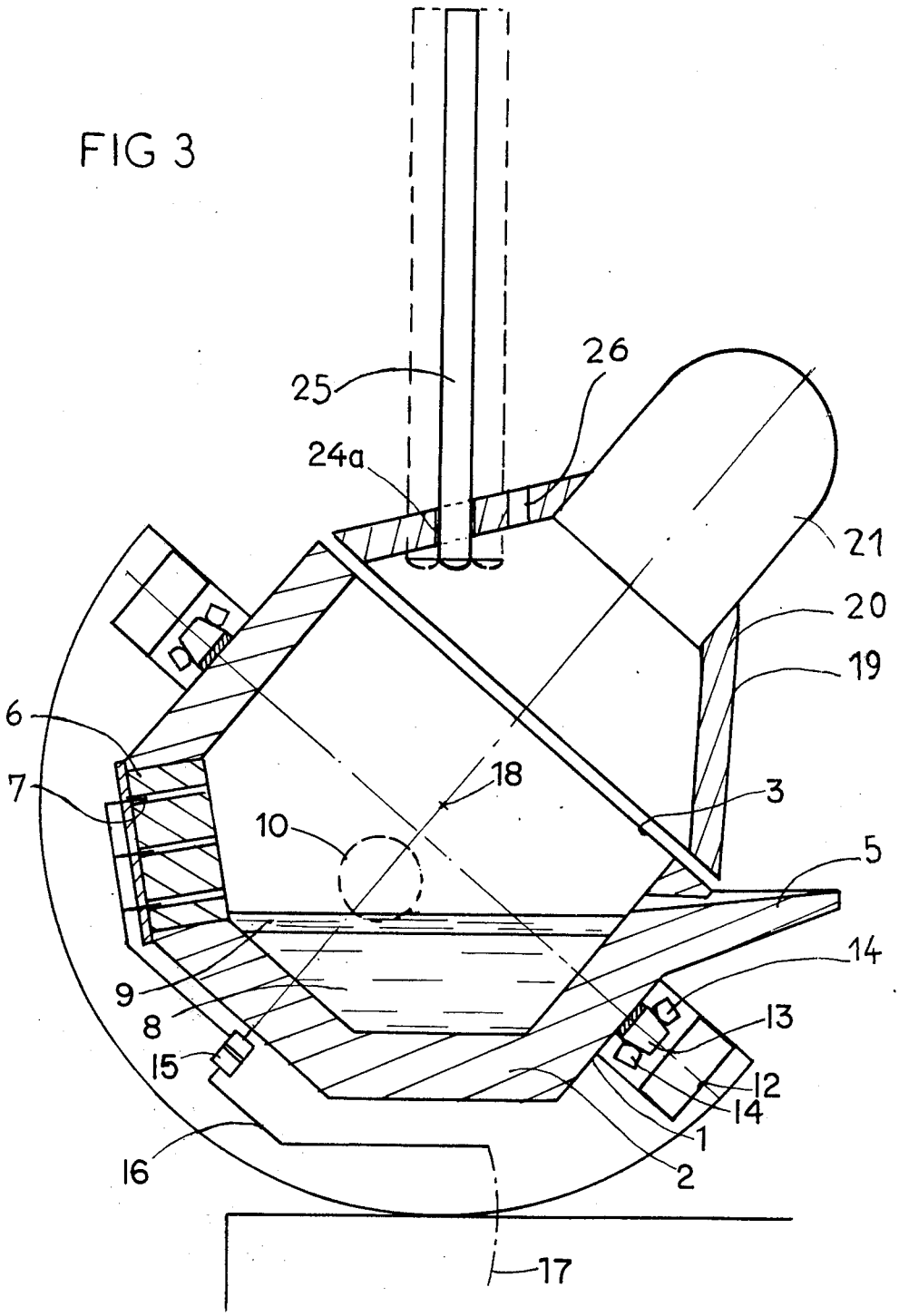
FIG. 3 is a vertical section through the converter of FIG. 1, again passing through its axis of revolution, but when the vessel has been turned through 180° with respect to the position of FIG. 1 and without any tilting and is in its operative for "putting the finishing touches" to the steel, that is to say, using the heating means but with the tuyeres clear of the bath.

In a top portion of the cap in the positions shown in FIGS. 1 and 3, the cap is pierced by three openings 24*a*, 24*b*, 24*c* (FIG. 5) through which three threephase electrodes 25 extend, and a fourth opening 26 for discontinuous or continuous feeding of solid matter to be added, such as prepared granular or prereduced products, ferroalloys, fluxes, etc. Although the openings appear elliptical in FIG. 5, they are circular and cylindrical along the vertical through the positions shown in FIGS. 1 and 3. The opening 26 is fed via a funnel 27.

Figure 4:
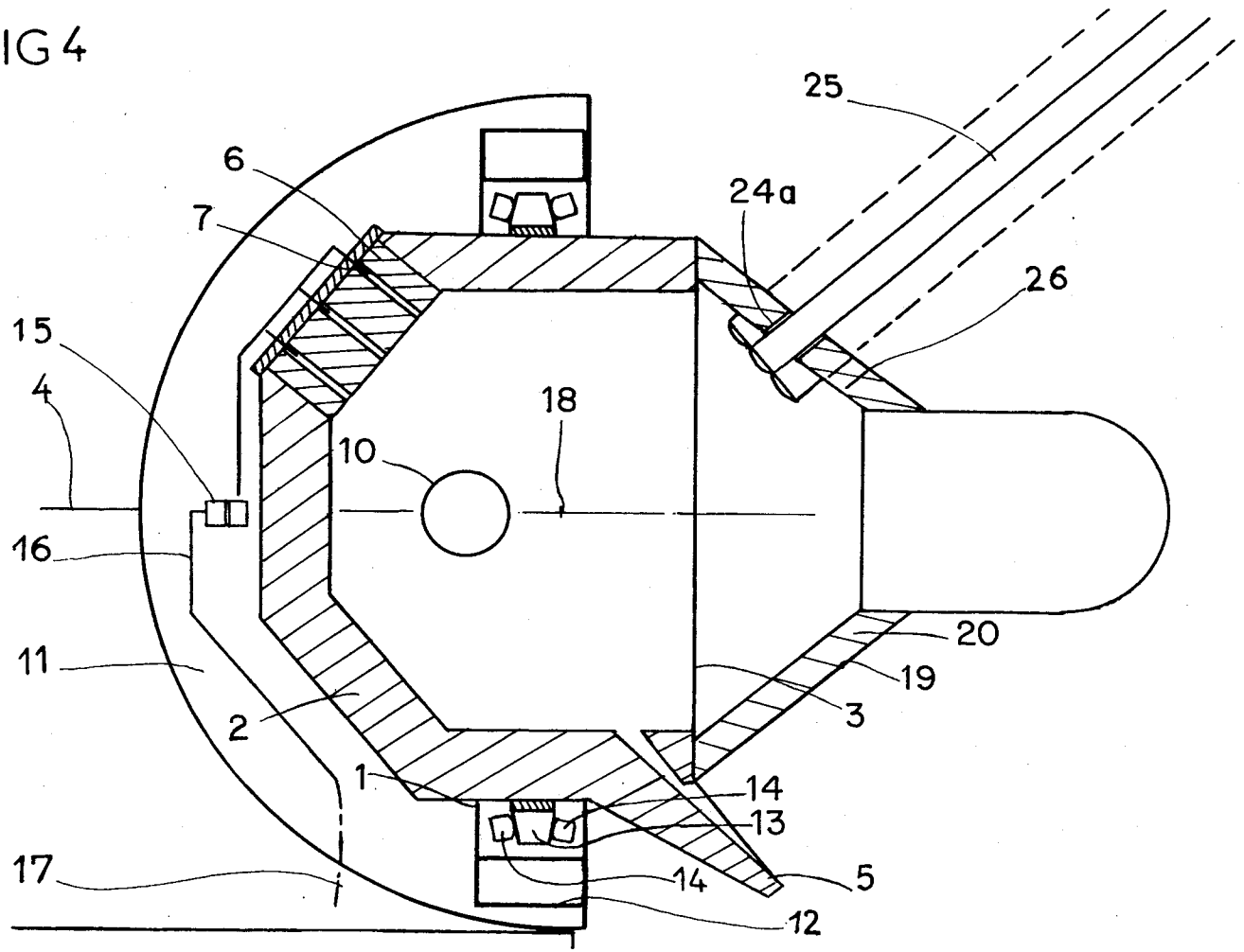
FIG. 4 is a vertical section of the converter of FIG. 1, again passing through its axis of revolution but after the converter vessel has been tilted through 90° with respect to FIG. 3 and without rotation of the vessel about its axis of revolution, with the result that the pouring spout is in its lower position, i.e. the position at the end of pouring into a ladle.

In the present embodiment, the electrode-carrier arms (not shown) are secured to the tilting cradle 11, which explains the position of the electrode 25 shown in FIG. 4. However the electrode-carrier arms need not be fast with the cradle.

Figure 2:
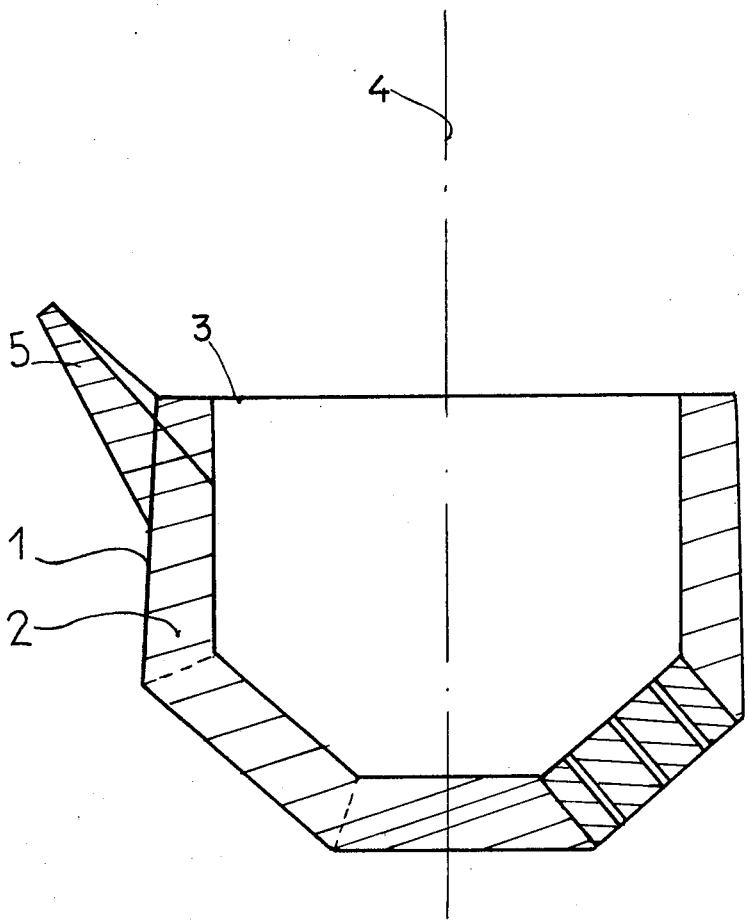
FIG. 2 is a vertical section through the vessel of the converter of FIG. 1 in the position for charging with scrap before the metallurgical operation, taken along the vertical plane through its vertical axis of revolution and through its pouring spout.

FIG. 2 shows the vessel 1 in the vertical position without the cap 19, in its initial positon for charging with scrap by basket as for an electric arc furnace of known type.

The rotary converter which has just been described may be operated in a number of different ways. One such method of operation is described below.

The vessel 1 is charged with scrap by basket in the position shown in FIG. 2. By tilting the cradle 11 the vessel 1 is brought to the position shown in FIG. 1, which is the 'normal' position for simultaneous heating and blowing in. In the plane 3 between the vessel 1 and the cap 19 there exists a very small gap. The electrodes 25 are lowered through the apertures 24*a*, 24*b*, 24*c* in the cap 19 and are energized while the tuyeres 7 start to blow in oxygen in order to speed up melting of the scrap, and then to refine the liquid bath. Smultaneously, various solid additions are introduced through the funnel 27 and the aperture 26. When required, one or more operations of raking out of the slag through the aperture 10 is performed by slightly rotating the vessel 1 about its axis 4, if necessary.

When the melting and the main refining are finished, one proceeds to putting the finel finishing touches to the steel with the vessel 1 either in the position shown in FIG. 1, if it is required to stir additions for putting the finishing touches by blowing in through the tuyeres, or in the position shown in FIG. 3 if it is desired to avoid any blowing in at this time. One can also, in either of these two positions, employ the heat of the electric arcs by relowering the electrodes in the event of a deficiency in the thermal balance.

After final raking through the aperture 10, the vessel 1 is rotated about its axis 4 to the position shown in FIG. 3 which is that immediately preceding the start of pouring of the steel into a ladle through the spout 5. At the end of the pouring operation, the vessel has the position shown in FIG. 4.

The above described method of operation shows the flexibility of operation of the above described rotary converter Of course, without departing from the scope of the invention, one may conceive of variants and improvements in detail, as well as the use of equivalent means.

There is thus provided a new type of converter with blowing-in by protected submerged tuyeres, which is provided with heating means and which exhibits all the advantages of blast power, of possibilities of tilting and of facilities for collection of the gases and feeding of the tuyeres, which are already found in traditional converters, but which also enables heating means to be employed during the course of refining, with the possibility of submerging the tuyeres or raising them above the surface at will, while preserving the use of the heating means.

With such a converter it is possible as described above to carry out simultaneously heating, melting and refining of the charge during a first period during the course of which the heating means and the tuyeres operate together, with or without continuous charging with solid matter, and then during a second period to proceed with additions for putting the last touches to the steel by continuing to employ the heating means but placing the tuyeres above the surface by a suitable rotation of the converter.

What is claimed is:

1. A converter for refining a liquid metal using simultaneous blowing in and heating, the converter comprising:

a metal vessel for receiving a liquid metal bath, internally lined with refractory material and having an upwardly open mouth, said vessel having a generally cylindro-frustoconical shape and being a body of revolution about an axis;

a cradle;

means mounting said vessel in said cradle for rotation relative thereto about said axis of revolution;

means mounting said cradle for tilting movement;

a pouring spout on said vessel;

a set of tuyeres extending through a wall of said vessel into the interior thereof;

a non-rotatable frustoconical cap secured to said cradle and lined with refractory material for surmounting said open mouth of said vessel, said cap being separate from said vessel, and defining an opening for receiving heating means; and a hood for collection of gases and communicating with said cap;

the arrangement being such that, in the 'normal' operative position of sid converter for simultaneous blowing in and heating, said axis of revolution of said vessel is at an angle of between 35° and 55° to the vertical, said pouring spout is directed upwardly, said tuyeres are arranged to be submerged in a metal bath and to blow in from the bottom of said vessel upwardly, and said vessel is surmounted by said cap.

2. A converter as claimed in claim 1, wherein said means mounting said vessel on said cradle includes rollers rolling in a cage secured to said cradle.

3. A converter as claimed in claim 1, including heating means selected from the group formed by: three threephase electrodes; a fuel-oil burner; a plasma torch; two single phase electrodes.

4. A converter as claimed in claim 1, comprising heating means movable vertically and introducible into said vessel downwards through said opening in said cap.

5. A converter as claimed in claim 1, wherein said cap includes an aperture surmounted by means for supplying solid matter thereto continously or discontinously.

6. A converter as claimed in claim 4, including means for supporting said heating means fast with said cradle.

7. A converter as claimed in claim 6, wherein said cap, said hood and support means for said heating means are mounted on a carriage, a false cap for said vessel being mounted on said carriage such that said false cap surmounts said vessel when said vessel is in the position for pouring.

8. A converter as claimed in claim 4, wherein said cap, said hood and said heating means are supported by a first carriage, a second carriage being provided supporting a false cap for the vessel which surmounts said vessel when it is in a position for pouring.

* * * * *